US012209480B1

(12) United States Patent
Trahan

(10) Patent No.: US 12,209,480 B1
(45) Date of Patent: Jan. 28, 2025

(54) TEMPORARY PIPE PLUGGING DEVICE FOR EXTREME PRESSURE

(71) Applicant: Trenergy Investments, LLC, Conroe, TX (US)

(72) Inventor: Kevin Trahan, Magnolia, TX (US)

(73) Assignee: Trenergy Investments, LLC, Conroe, TX (US)

( * ) Notice: Subject to any disclaimer, the term of this patent is extended or adjusted under 35 U.S.C. 154(b) by 0 days.

(21) Appl. No.: 18/380,867

(22) Filed: Oct. 17, 2023

(51) Int. Cl.
*E21B 33/12* (2006.01)
*E21B 34/06* (2006.01)

(52) U.S. Cl.
CPC ..... *E21B 33/1208* (2013.01); *E21B 34/063* (2013.01)

(58) Field of Classification Search
CPC ... E21B 33/1208; E21B 34/063; E21B 34/103
See application file for complete search history.

(56) References Cited

U.S. PATENT DOCUMENTS 5,479,986 A 1/1996 Gano et al.
8,322,448 B2 12/2012 Brandsdal
9,222,322 B2 12/2015 Brandsdal
9,593,542 B2 3/2017 Getzlaf et al.
10,107,070 B2 10/2018 Yong et al.
10,465,445 B2 11/2019 Getzlaf et al.
11,808,109 B1 * 11/2023 Conner ..... E21B 34/063
11,965,395 B1 * 4/2024 von Gynz-Rekowski ..... E21B 34/063
2018/0371869 A1 12/2018 Kellner et al.
2019/0017345 A1 1/2019 Brandsdal
2021/0340836 A1 * 11/2021 Brandsdal ..... E21B 33/1208
2023/0279736 A1 * 9/2023 Eriksen ..... E21B 17/1078 166/192

FOREIGN PATENT DOCUMENTS

WO WO-2019183160 A1 * 9/2019 ..... E21B 33/10

* cited by examiner

*Primary Examiner* — James G Sayre
(74) *Attorney, Agent, or Firm* — Tumey L.L.P.

(57) ABSTRACT

An apparatus that provides for the temporary plugging of a pipe string is disclosed. In an embodiment, the apparatus is a temporary tubing plug apparatus comprising a housing having an axial internal passageway. The housing being connected to a pipe string on at least a first end of the housing. The temporary tubing plug apparatus also includes a frangible plug. The frangible plug having a first support surface and a second support surface, supported within the housing. The frangible plug also has a first position where its first support surface is supported by a first resilient cushioning material which is permanently bonded to a rigid substrate.

17 Claims, 5 Drawing Sheets

TEMPORARY PIPE PLUGGING DEVICE FOR EXTREME PRESSURE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Invention

This invention relates to a downhole pressure containment and temporary pipe plugging apparatus for use in the oil and gas industry. More particularly, the apparatus of the present invention provides a plugging apparatus, which may be used as a pressure containment device, which prevents passage of wellbore fluids through the internal axial passageway of the plug, until it is desired to open the internal axial passageway through the plugging apparatus for flow of fluid in either direction through an internal axial passageway of a pipe string. It is to be understood that the pipe strings used in oil and gas wells are generally known as tubing and casing by one of ordinary skill in the art. This invention is applicable to both tubing and casing applications, and may be used for various well operation functions, including floatation of casing, well control barrier for installation of tubing in a live well, and setting of hydraulically actuated tubing tools, such as a packer. The device of this invention is capable of supporting extreme pressure in either, or both directions, by implementation of a support mechanism which permanently resides within the temporary plugging device, therefore eliminating downhole debris, of a shape and size, which could damage downhole equipment, or plug surface equipment upon production of wellbore fluids. Furthermore, the temporary plugging device accomplishes minimal wellbore debris by utilizing a frangible plug, in concert with one, or more, support mechanism(s) which results in an unrestricted passageway through the apparatus for subsequent wellbore operations, as well as future production of wellbore fluids and formation fluids.

Background of the Invention

Current techniques for temporarily plugging tubing, or casing, strings utilize plugs which can be degraded, removed, or pulverized. When it comes to use of glass plugs, which become pulverized for opening the device's internal axial passageway, the current techniques utilize support mechanisms which maintains the axial position and integrity of the plug, until a moment when the plug is desired to be pulverized. The pulverized plugs are typically made from high strength and brittle materials, such as ceramic or glass.

The current techniques which utilize ceramic have drawbacks. For instance, the typical ceramic plug is manufactured in the shape of a dome, which provides an outer surface of the dome and an inner surface of the dome. Ceramic has extremely high resistance to compressive forces and low resistance to tensile forces. Therefore, a dome-shaped ceramic plug may successfully resist extreme pressure when pressure is applied to the external dome surface, however the dome-shaped ceramic plug may not be successful at resisting even medium pressure when pressure is applied to the internal dome surface. Therefore, for a plugging device utilizing ceramic plug(s), which may be required to contain pressure in both directions, two opposing dome-shaped ceramic plugs may be utilized. In the case where two opposing dome-shaped ceramic plugs are utilized, an atmospheric chamber is formed between the opposing ceramic plugs, which may reduce reliability due to introduction of additional seal engagements creating potential failure-creating leak paths.

Moreover, ceramic plugs have a known tendency to breakup into unpredictable large and therefore unmanageable debris pieces.

Current techniques which utilize glass may be deficient as well. Glass plugs which are supported by steel support mechanisms are limited due to the point stresses created in the glass when held by an unforgiving surface, which leads to unpredictable and unreliable pressure holding capability. There are some techniques which employ pliable, and forgiving, padding to cushion the glass plug against a steel, or the like, support mechanism. However, that padding is often lost into the well upon pulverization of the glass plug. And, glass plugs are typically sealed to its respective housing by use of an o-ring, which also may become lost in the well upon pulverization. Therefore, undesirable debris may be created which may cause damage to the well, production from the wellbore, or formation production.

Consequently, there is a need for a temporary pipe plugging device which only leaves wellbore debris generated by the plug itself, while eliminating potentially damaging debris caused by use of loose cushion and sealing materials.

BRIEF SUMMARY OF SOME OF THE PREFERRED EMBODIMENTS

These and other needs in the art are addressed in one embodiment by an apparatus for temporary plugging of a pipe string. The temporary tubing plug apparatus comprising a housing having an axial internal passageway. The housing being connected to a pipe string on at least a first end of the housing. The temporary tubing plug apparatus also having a frangible plug having a first support surface and a second support surface, supported within the housing. The frangible plug having a first position where its first support surface is supported by a first resilient cushion support which is permanently bonded to an upper support shoulder.

These and other needs in the art are addressed in another embodiment by temporary tubing plug apparatus for temporary plugging of a pipe string. The temporary tubing plug apparatus comprising a housing having an axial internal passageway. The housing being connected to a pipe string on at least a first end of the housing. The temporary tubing plug apparatus having a frangible plug. The frangible plug having a first support surface and a second support surface, supported within the housing. The frangible plug is connected with the housing via an activation sleeve. The second support surface of the frangible plug is supported by a lower support shoulder.

Embodiments also include a temporary tubing plug apparatus for use in the oil and gas industry for installation and completion of well tubular strings. The temporary tubing plug apparatus provides a temporary pressure containment plug, which may be pulverized, or removed, at a desired moment by use of hydraulic pressure, or dropping of a bar which impacts and pulverizes the plug. In accordance with embodiments, temporary tubing plug apparatus is a pressure containment and temporary tubing plugging apparatus having a housing providing an axial passageway therethrough, and the housing is attached to or within a well tubular string at its first end and second end, unless the apparatus is the lower end of the well tubular string, in which case the housing is only attached to the well tubular string on the housing's first end. The plug of the plugging apparatus has a first position within the housing, which is retained by a first (upper) support mechanism and a second (lower) support mechanism. At least one of the first or second support mechanisms has a resilient cushioning surface which is permanently attached to a rigid substrate. Once the temporary tubing plug apparatus is removed, the axial passageway through the open temporary tubing plugging apparatus has an effective internal diameter that may be equal to the internal diameter of the well tubular string, which may ensure safe passage of fluids and other well tools, while the plugging apparatus within the well tubular string leaves no additional unmanageable debris in the well (which may be in the form of an o-ring, padding material, screw remnants, chunks of ceramic, etc, which could impede future well performance).

This temporary tubing plug apparatus overcomes drawbacks of conventional techniques by utilizing a frangible plug which is supported by a forgiving cushion which is permanently adhered, or bonded, to a steel, or rigid, substrate so the forgiving cushion material never leaves the housing of the temporary plugging device, and therefore does not leave undesired and unmanageable debris inside the well which may damage other equipment, and/or impede production. The forgiving cushion material may increase the ultimate pressure that the frangible plug can withstand by reducing stress at the contact point(s) between the plug and a rigid support, therefore increasing robustness and reliability in high pressure applications (i.e., 20,000 psi pressure applications).

Furthermore, this temporary tubing plug incorporates a sealing mechanism between the frangible plug and the inside of the temporary tubing plug housing. That sealing mechanism is manufactured from a resilient sealing material, i.e., rubber or polyurethane, which is pliable and strong enough to store energy suitable to successfully seal the plug to the housing in high pressure applications (i.e., 20,000 psi). The sealing mechanism further includes a metal, or rigid substrate, to which the resilient sealing material is permanently bonded. And, therefore the resilient sealing material is retained within the temporary tubing plugging device, away from the internal passageway of the open temporary tubing plugging device, where nothing can be damaged by the resilient sealing material.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

In oilfield applications, tubular shaped pipe strings are used for various applications, including, but not limited to casing surrounding formations, deploying downhole tools, production conduits, and service conduits. Pipe strings are made by connecting individual pipe segments together on their ends. Pipe segments are typically referred to as tubing joints, casing joints, and/or work-string joints. One of ordinary skill in the art understands that commonly termed tubing tools are commonly used for casing applications, and commonly termed casing tools are commonly used for tubing applications. Embodiments include a temporary tubing plug. The temporary tubing plug includes any plug which meets the limitations of the present disclosure herein, whether the plug is part of a tubing string, a casing string, or a work-string.

Figure 1:
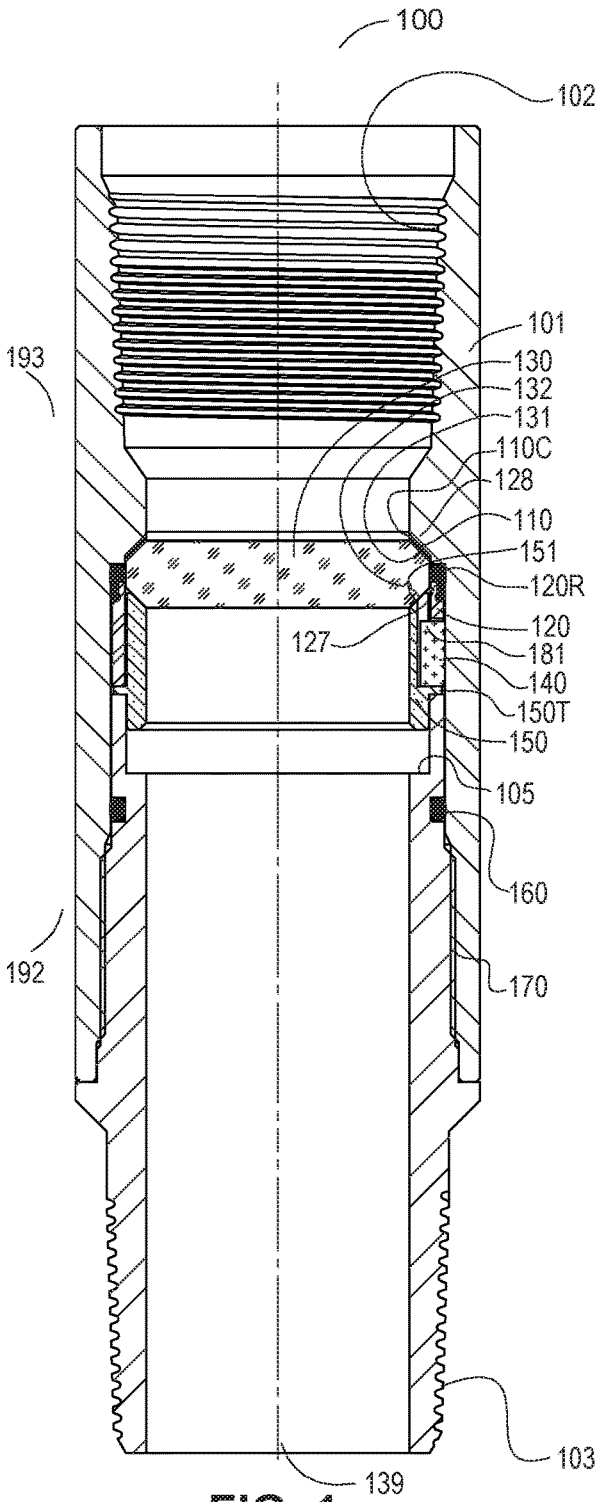
FIG. 1 illustrates a sectional view of an embodiment of the temporary tubing plug in a first, or run-in position.

With reference to FIG. 1, the general components of a temporary tubing plug device 100 are shown, which include a first end 193 and a second end 192 of temporary tubing plug device 100. Temporary tubing plug device 100 has a housing 101 which has an upper housing connection 102 and a lower housing connection 103. The upper housing connection 102 and the lower housing connection 103 allow for the temporary tubing plug device 100 to be attached within (i.e., to a pipe string) a pipe string (not illustrated) between connections of two pipe segments (not illustrated). In embodiments, first end 193 of temporary tubing plug device 100 (i.e., first end 193 of housing 101) is connected to a pipe string. In embodiments, first end 193 and at least one other portion of housing 101 is connected to a pipe string. A frangible plug 130 resides within the housing 101 and is held in place on its first support surface 131 within the housing 101 by upper support shoulder 110, which has a resilient cushion support 110C that is permanently bonded to upper support shoulder 110. Upper support shoulder 110 may be formed of any suitable material for wellbore use. In embodiments, resilient cushion support rigid substrate 128 forms upper support shoulder 110. Resilient cushion support rigid substrate 128 may be composed of any suitable materials for use with temporary tubing plug device 100 in a well bore environment. In embodiments, resilient cushion support rigid substrate 128 is a metallic substrate. The metallic substrate used to form resilient cushion support rigid substrate 128 may be made from similar materials used for manufacture of pipe segments, including but not limited to carbon steel, chrome, inconel, bronze, aluminum, or any combinations thereof. Frangible plug 130 is held in its run-in, or first, position, on its second support surface 132, by the lower support shoulder 151, which is shown as the first, or upper, end of the activation sleeve 150. Frangible plug 130 may be composed of any suitable material such as glass, ceramic, graphite, ionic solids, or any combinations thereof. In an embodiment, frangible plug 130 comprises glass.

As further shown in FIG. 1, activation sleeve 150 is releasably connected to housing 101 by activation shear tab 150T of the activation sleeve 150. The activation shear tab 150T is manufactured to "shear", or break, at a predetermined force (i.e., pressure) which is achieved by hydraulic pressure against the frangible plug 130 that is in sealing engagement with an internal surface of housing 101. Without limitation, the range of force, or pressure, which may be desired for activation is dependent on the application in which the temporary tubing plug device 100 is utilized. The pressure may be low, such as 500 psi, in an application where the frangible plug 130 is desired to hold pressure from below the temporary tubing plug device 100. The pressure may be significantly high, such as 20,000 psi, for applications where the frangible plug 130 is desired to hold a pressure differential applied above the temporary tubing plug device 100, such as, for activation of equipment placed up-hole in the pipe string, or floating pipe into a well by creation of an atmospheric chamber below the temporary tubing plug device 100. In embodiments as shown, frangible plug 130 is thereby releasably connected within (i.e., to) housing 101 via activation sleeve 150.

As shown in FIG. 1, frangible plug 130 is in sealing engagement with housing 101 by bonded seal 120. Bonded seal 120 has a resilient elastomeric portion 120R which is permanently bonded to a resilient elastomeric portion rigid substrate 127 of the bonded seal 120. Impact pin 140 is held in place between the activation sleeve 150 and the housing 101. Resilient elastomeric portion 120R may be composed of any suitable components. In embodiments, resilient elastomeric portion 120R comprises rubber, polyurethane, or any combinations thereof. Resilient elastomeric portion 120R may have any suitable Shore A hardness. In embodiments, resilient elastomeric portion 120R has a Shore A hardness of 8595 durometers. Impact pin 140 has an upper end 181 which is configured to rupture the frangible plug 130, upon impact. The upper end 181 of impact pin 140 is spaced away from the frangible plug 130 while temporary tubing plug device 100 is in its first, or plugged, position. Stop shoulder 105, located within housing 101, is configured to stop downward movement of the activation sleeve 150 when it reaches the second, or open, position. It is understood by one of ordinary skill in the art, that there may be one, or a plurality of, impact pins 140, used to ensure desirable breaking, or shattering, of the frangible plug 130. In embodiments, when an impact pin 140, or surface is mentioned in this disclosure, it is meant to include the possibility of a plurality of that feature.

As also shown, housing 101 in this embodiment is split into two components in order to a create a cavity for the frangible plug 130 and the other internal components. The two components which makeup the entirety of housing 101 are shown to be connected by coupling thread 170 and the two components are sealingly engaged by use of coupling seal 160.

Figure 1A:
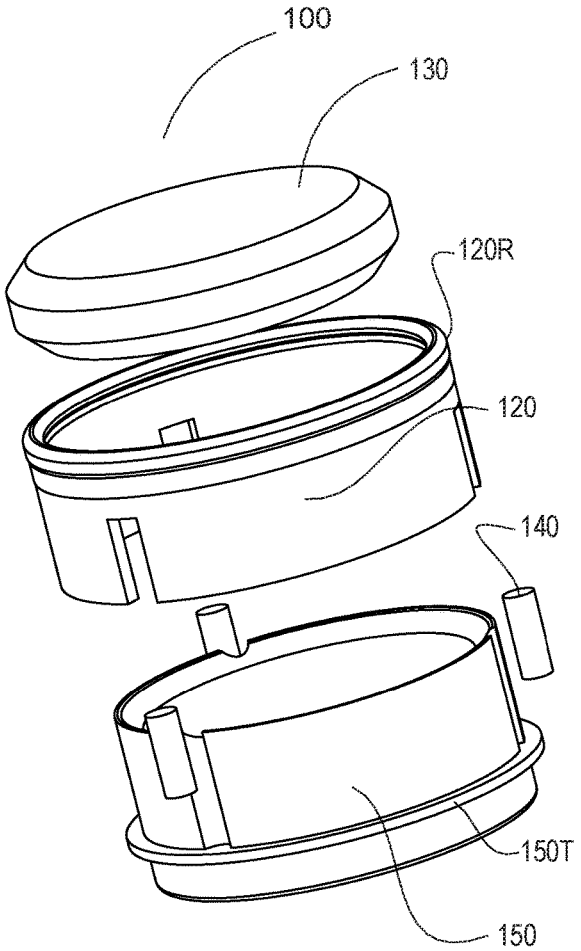
FIG. 1A illustrates a perspective view showing the activation sleeve, plug, bonded seal, and break pins from the embodiment of the temporary tubing plug shown in FIG. 1.

With reference to FIG. 1A, some of the internal components of temporary tubing plug device 100 are shown in an exploded perspective view, so to provide clarity as to the design features of the embodiment of temporary tubing plug device 100 revealed in FIG. 1. Components shown in FIG. 1A are discussed in the preceding paragraphs. Shown are frangible plug 130, bonded seal 120, impact pin 140, and activation sleeve 150.

Figure 1B:
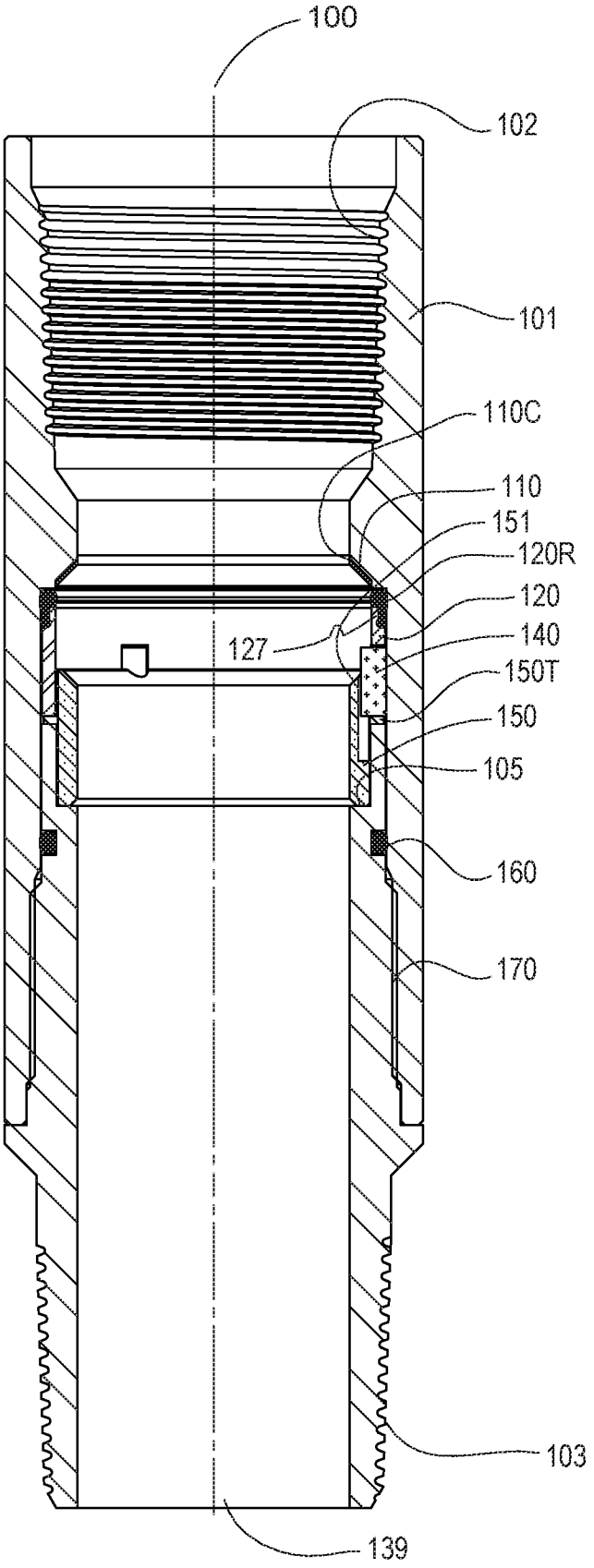
FIG. 1B illustrates a sectional view of the temporary tubing plug embodiment shown in FIG. 1, but shown in a second, or open position.

With reference to FIG. 1B, the second, or open, position of the temporary tubing plug device 100 is revealed. FIG. 1B shows the same embodiment of the temporary tubing plug device 100 shown in FIG. 1, except that the embodiment is shown in the second, or open, position. The second position is accomplished by breaking or shearing of the activation shear tab 150T. Activation shear tab 150T breaks off of activation sleeve 150 when a prescribed hydraulic pressure is applied above the frangible plug 130. The range of force, or pressure, which may be desired for activation is dependent on the application in which the temporary tubing plug device 100 is utilized. The pressure may be low, such as 500 psi, in an application where the frangible plug 130 is desired to hold pressure from below the temporary tubing plug device 100. The pressure may be significantly high, such as 20,000 psi, for applications where the frangible plug 130 is desired to hold a pressure differential applied above the temporary tubing plug device 100, such as, for activation of equipment placed up-hole in the pipe string, or floating pipe into a well by creation of an atmospheric chamber below the temporary tubing plug device 100. From the moment the activation shear tab 150T breaks, the frangible plug 130 is forced toward the second end 192 of the temporary tubing plug device 100, as the activation sleeve 150 is pushed toward the stop shoulder 105, the frangible plug 130, is impaled by impact pin 140, which causes pulverization (i.e., frangible plug 130 breaks into small pieces) of the frangible plug 130. The temporary tubing plug device 100 of FIG. 1B is shown in the fully open position and has no restriction to passage of tools, well fluids, or hydrocarbon media. An advantage to temporary tubing plug device 100 as shown is that resilient cushion support 110C and resilient elastomeric portion 120R remain permanently bonded to their respective rigid substrates (resilient cushion support rigid substrate 128 and resilient elastomeric portion rigid substrate 127, respectively), and are retained within the open temporary tubing plug device 100, away from the axial internal passageway 139 of the temporary tubing plug device 100 (i.e., axial internal passageway of housing 101), and therefore are not lost within the well bore to cause future problems with well operations or production operations. In addition, the small pieces of broken frangible plug 130 are moved through the pipe string which leaves temporary tubing plug device 100 with axial passageway 139 having an equal or greater diameter to the pipe string.

Figure 2:
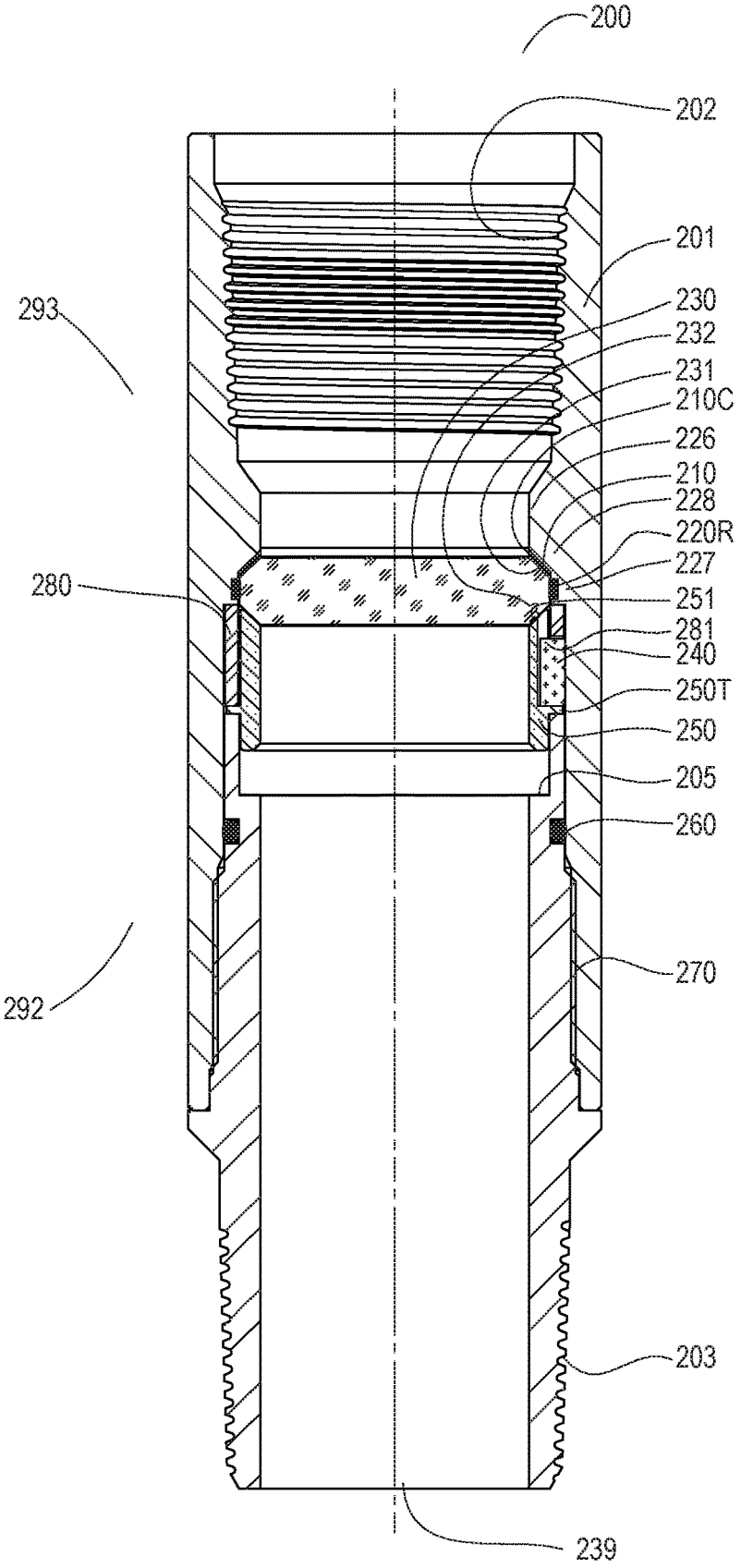
FIG. 2 illustrates a sectional view of a second embodiment of the temporary tubing plug in a first, or run-in position, which reveals a temporary tubing plug where an upper support cushion and a resilient seal are permanently bonded to the housing of the temporary tubing plug.

With reference to FIG. 2, the general components of a temporary tubing plug device 200 are illustrated in a further embodiment, which include a first end 293 and second end 292 of temporary tubing plug device 200. Temporary tubing plug device 200 has a housing 201 which has an upper housing connection 202 and a lower housing connection 203. The upper housing connection 202 and the lower housing connection 203 allow for the temporary tubing plug device 200 to be attached within (i.e., to) a pipe string (not illustrated) between connections of two pipe segments (not illustrated). In embodiments, first end 293 of temporary tubing plug device 200 (i.e., first end 293 of housing 201) is connected to a pipe string. In embodiments, first end 293 and at least one other portion of housing 201 are connected to a pipe string. A frangible plug 230 resides within the housing 201 and held in place on its first support surface 231 within the housing 201 by upper support shoulder 210, which has a resilient cushion support 210C that is permanently bonded to upper support shoulder 210. Upper support shoulder 210 may be formed of any suitable material for wellbore use. In embodiments, resilient cushion support rigid substrate 228 forms upper support shoulder 210. Resilient cushion support rigid substrate 228 may be composed of any suitable materials for use with temporary tubing plug device 200 in a well bore environment. In embodiments, resilient cushion support rigid substrate 228 is a metallic substrate. The metallic substrate used to form resilient cushion support rigid substrate 228 may be made from similar materials used for manufacture of pipe segments, including but not limited to carbon steel, chrome, inconel, bronze, aluminum, or any combinations thereof. Frangible plug 230 is held in its run-in, or first, position, on its second support surface 232, by the lower support shoulder 251, which is shown as the first, or upper, end of the activation sleeve 250. Frangible plug 230 may be composed of any suitable material such as glass, ceramic, graphite, ionic solids, or any combinations thereof. In an embodiment, frangible plug 230 comprises glass.

FIG. 2 shows that activation sleeve 250 is releasably connected to housing 201 by activation shear tab 250T of the activation sleeve 250. The activation shear tab 250T is manufactured to "shear", or break, at a predetermined force (i.e., pressure) which is achieved by hydraulic pressure against the frangible plug 230 which is in sealing engagement with an internal surface of housing 201. The range of force, or pressure, which may be desired for activation is dependent on the application in which the temporary tubing plug device 200 is utilized. The pressure may be low, such as 500 psi, in an application where the frangible plug 230 is desired to hold pressure from below the temporary tubing plug device 200. The pressure may be significantly high, such as 20,000 psi, for applications where the frangible plug 230 is desired to hold a pressure differential applied above the temporary tubing plug 200, such as, for activation of equipment placed up-hole in the pipe string, or floating pipe into a well by creation of an atmospheric chamber below the temporary tubing plug device 200. In embodiments as shown, plug 230 is thereby releasably connected within (i.e., to) housing 201 via activation sleeve 250.

As shown in FIG. 2, frangible plug 230 is in sealing engagement with housing 201 by resilient elastomeric portion 220R which is permanently bonded to a resilient elastomeric portion rigid substrate 227 of the housing 201. Impact pin 240 is held in place between the activation sleeve 250 and the housing 201. Cage 280 remains in a static position within housing 201 below resilient elastomeric portion 220R and above the upper surface of activation shear tab 250T. Cage 280 is configured to limit movement of the impact pin 240, in order to ensure that impact pin 240 is not allowed to fall into the axial internal passageway 239 of the temporary tubing plug device 200. Impact pin 240 has an upper end 281 which is configured to rupture the frangible plug 230, upon impact. The upper end 281 of impact pin 240 is spaced away from the frangible plug 230 while temporary tubing plug device 200 is in its first, or plugged, position. Stop shoulder 205, located within housing 201, is configured to stop downward movement of the activation sleeve 250 when it reaches the second, or open, position.

Housing 201 in this embodiment of FIG. 2 is split into two components in order to a create a cavity for the frangible plug 230 and the other internal components. The two components which makeup the entirety of housing 201 are shown to be connected by coupling thread 270 and the two components are sealingly engaged by use of coupling seal 260.

FIG. 2 shows that the second, or open, position of the temporary tubing plug device 200 is accomplished by breaking, or shearing, of the activation shear tab 250T. Activation shear tab 250T breaks off of activation sleeve 250 when a prescribed hydraulic pressure is applied above the frangible plug 230. The range of force, or pressure, which may be desired for activation is dependent on the application in which the temporary tubing plug device 200 is utilized. The pressure may be low, such as 500 psi, in an application where the frangible plug 230 is desired to hold pressure from below the temporary tubing plug device 230. The pressure may be significantly high, such as 20,000 psi, for applications where the frangible plug 230 is desired to hold a pressure differential applied above the temporary tubing plug device 200, such as, for activation of equipment placed up-hole in the pipe string, or floating pipe into a well by creation of an atmospheric chamber below the temporary tubing plug device 200. From the moment the activation shear tab 250T breaks, the frangible plug 230 is forced toward the second end 292 of the temporary tubing plug device 200, as the activation sleeve 250 is pushed toward the stop shoulder 205, the frangible plug 230, is impaled by impact pin 240, which causes pulverization (i.e., frangible plug 230 breaking into small pieces) of the frangible plug 230.

Advantages of temporary tubing plug device 200 are that resilient cushion support 210C and resilient elastomeric portion 220R remain permanently bonded to the housing rigid substrate 226 of the housing 201 (which housing rigid substrate 226 includes resilient elastomeric portion rigid substrate 227 and resilient cushion support rigid substrate 228), and are retained within the open temporary tubing plug device 200, away from the axial internal passageway 239 of the temporary tubing plug device 200 (i.e., axial internal passageway of housing 201), and therefore are not lost within the well bore to cause future problems with well operations or production operations. In addition, the small pieces of broken frangible plug 230 are moved through the pipe string which leaves temporary tubing plug device 200 with an axial passageway 239 having an equal or greater diameter to the pipe string.

Figure 3:
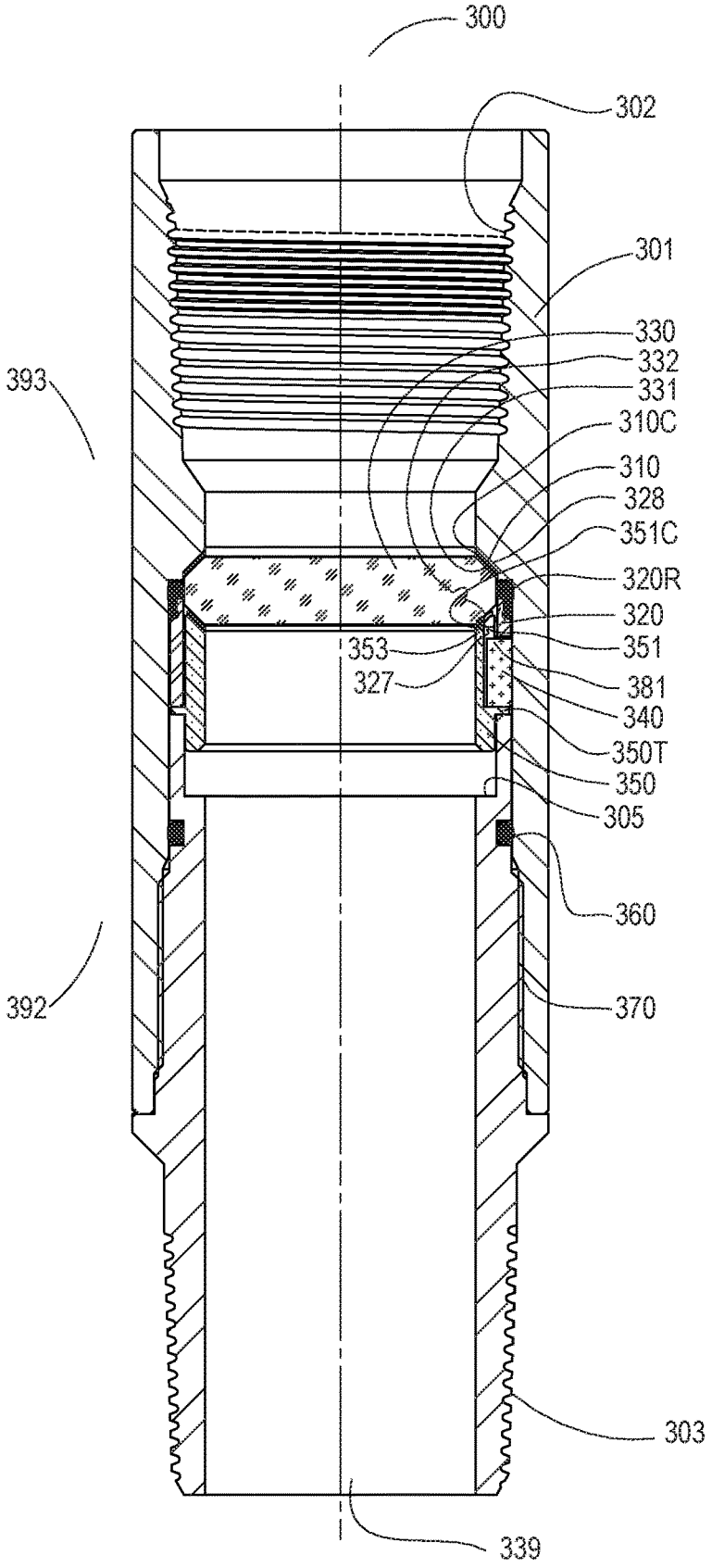
FIG. 3 illustrates a sectional view of a third embodiment with the temporary tubing plug in a first, or run-in position, which reveals a temporary tubing plug where an upper support cushion is permanently bonded to the housing of the temporary tubing plug, and the resilient seal is permanently bonded to a separate rigid substrate with the shear sleeve support surface having a lower support cushion permanently bonded to its surface.

FIG. 3 illustrates an additional embodiment of temporary tubing plug device 300 showing a first end 393 and second end 392 of temporary tubing plug device 300. Temporary tubing plug device 300 has a housing 301 which has an upper housing connection 302 and a lower housing connection 303. The upper housing connection 302 and the lower housing connection 303 allow for the temporary tubing plug device 300 to be attached within (i.e., to) a pipe string (not illustrated) between connections of two pipe segments (not illustrated). In embodiments, first end 393 of temporary tubing plug device 300 (i.e., first end 393 of housing 301) is connected to a pipe string. In embodiments, first end 393 and at least one other portion of housing 301 is connected to a pipe string. A frangible plug 330 resides within the housing 301 and held in place on its first support surface 331 within the housing 301 by upper support shoulder 310, which has a resilient cushion support 310C which is permanently bonded to upper support shoulder 310. Upper support shoulder 310 may be formed of any suitable material for wellbore use. In embodiments, resilient cushion support rigid substrate 328 forms upper support shoulder 310. Resilient cushion support rigid substrate 328 may be composed of any suitable materials for use with temporary tubing plug device 300 in a well bore environment. In embodiments, resilient cushion support rigid substrate 328 is a metallic substrate. The metallic substrate used to form resilient cushion support rigid substrate 328 may be made from similar materials used for manufacture of pipe segments, including but not limited to carbon steel, chrome, inconel, bronze, aluminum, or any combinations thereof. Frangible plug 330 is held in its run-in, or first, position, on its second support surface 332, by the lower support shoulder 351, which has a resilient cushion support 351C which is permanently bonded to lower support shoulder 351 of the activation sleeve 350. In embodiments, resilient cushion support 351C is permanently bonded to activation sleeve rigid substrate 353 that forms lower support shoulder 351 of activation sleeve 350. Activation sleeve rigid substrate 353 may be composed of any suitable materials for use with temporary tubing plug device 300 in a well bore environment. In embodiments, activation sleeve rigid substrate 353 is a metallic substrate. The metallic substrate used to form resilient activation sleeve rigid substrate 353 may be made from rigid materials, including but not limited to carbon steel, cast iron, chrome, inconel, bronze, aluminum, or any combinations thereof. Frangible plug 330 may be composed of any suitable material such as glass, ceramic, graphite, ionic solids, or any combinations thereof. In an embodiment, frangible plug 330 comprises glass.

FIG. 3 shows that activation sleeve 350 is releasably connected to housing 301 by activation shear tab 350T of the activation sleeve 350. The activation shear tab 350T is manufactured to "shear", or break, at a predetermined force (i.e., pressure) which is achieved by hydraulic pressure against the frangible plug 330 which is in sealing engagement with an internal surface of housing 301. The range of force, or pressure, which may be desired for activation is dependent on the application in which the temporary tubing plug device 300 is utilized. The pressure may be low, such as 500 psi, in an application where the frangible plug 330 is desired to hold pressure from below the temporary tubing plug device 300. The pressure may be significantly high, such as 20,000 psi, for applications where the frangible plug 330 is desired to hold a pressure differential applied above the temporary tubing plug device 300, such as, for activation of equipment placed up-hole in the pipe string, or floating pipe into a well by creation of an atmospheric chamber below the temporary tubing plug device 300. In embodiments as shown, frangible plug 330 is thereby releasably connected within (i.e., to) housing 301 via activation sleeve 350.

As shown in FIG. 3, frangible plug 330 is in sealing engagement with housing 301 by bonded seal 320. Bonded seal 320 has a resilient elastomeric portion 320R which is permanently bonded to a resilient elastomeric portion rigid substrate 327 of the bonded seal 320. Impact pin 340 is held in place between the activation sleeve 350 and the housing 301. Resilient elastomeric portion 320R may be composed of any suitable components. In embodiments, resilient elastomeric portion 320R comprises rubber, polyurethane, or any combinations thereof. Resilient elastomeric portion 320R may have any suitable Shore A hardness. In embodiments resilient elastomeric portion 320R has a Shore A hardness of 85-95 durometers. Impact pin 340 has an upper end 381 which is configured to rupture the frangible plug 330, upon impact. The upper end 381 of impact pin 340 is spaced away from the frangible plug 330 while temporary tubing plug device 300 is in its first, or plugged, position. Stop shoulder 305, located within housing 301, is configured to stop downward movement of the activation sleeve 350 when it reaches the second, or open, position.

Housing 301 in this embodiment of FIG. 3 is split into two components in order to a create a cavity for the frangible plug 330 and the other internal components. The two components which makeup the entirety of housing 301 are shown to be connected by coupling thread 370 and the two components are sealingly engaged by use of coupling seal 360.

As shown in FIG. 3, the second, or open, position (not shown in this disclosure) of the temporary tubing plug device 300 is accomplished by breaking, or shearing, of the activation shear tab 350T. Activation shear tab 350T breaks off of activation sleeve 350 when a prescribed hydraulic pressure is applied above the frangible plug 330. The range of force, or pressure, which may be desired for activation is dependent on the application in which the temporary tubing plug device 300 is utilized. The pressure may be low, such as 500 psi, in an application where the frangible plug 330 is desired to hold pressure from below the temporary tubing plug device 300. The pressure may be significantly high, such as 20,000 psi, for applications where the frangible plug 330 is desired to hold a pressure differential applied above the temporary tubing plug device 300, such as, for activation of equipment placed up-hole in the pipe string, or floating pipe into a well by creation of an atmospheric chamber below the temporary tubing plug device 300. From the moment the activation shear tab 350T breaks, the frangible plug 330 is forced toward the second end 392 of the temporary tubing plug device 300, as the activation sleeve 350 is pushed toward the stop shoulder 305, the frangible plug 330, is impaled by impact pin 340, which causes pulverization (i.e., frangible plug 330 breaking into small pieces) of the frangible plug 330. In addition, the small pieces of broken frangible plug 330 are moved through the pipe string which leaves temporary tubing plug device 300 with an axial passageway 339 having an equal or greater diameter to the pipe string.

An advantage of temporary tubing plug device 300 is that resilient cushion support 310C, resilient elastomeric portion 320R, and resilient cushion support 351C remain permanently bonded to their respective rigid substrates (resilient cushion support rigid substrate 328, resilient elastomeric portion rigid substrate 327, and activation sleeve rigid substrate 353, respectively). So, all of those resilient materials are retained within the open temporary tubing plug device 300, away from the axial internal passageway 339 of the temporary tubing plug device 300 (i.e., axial internal passageway 339 of housing 301), and therefore are not lost within the well bore to cause future problems with well operations or production operations.

Figure 4:
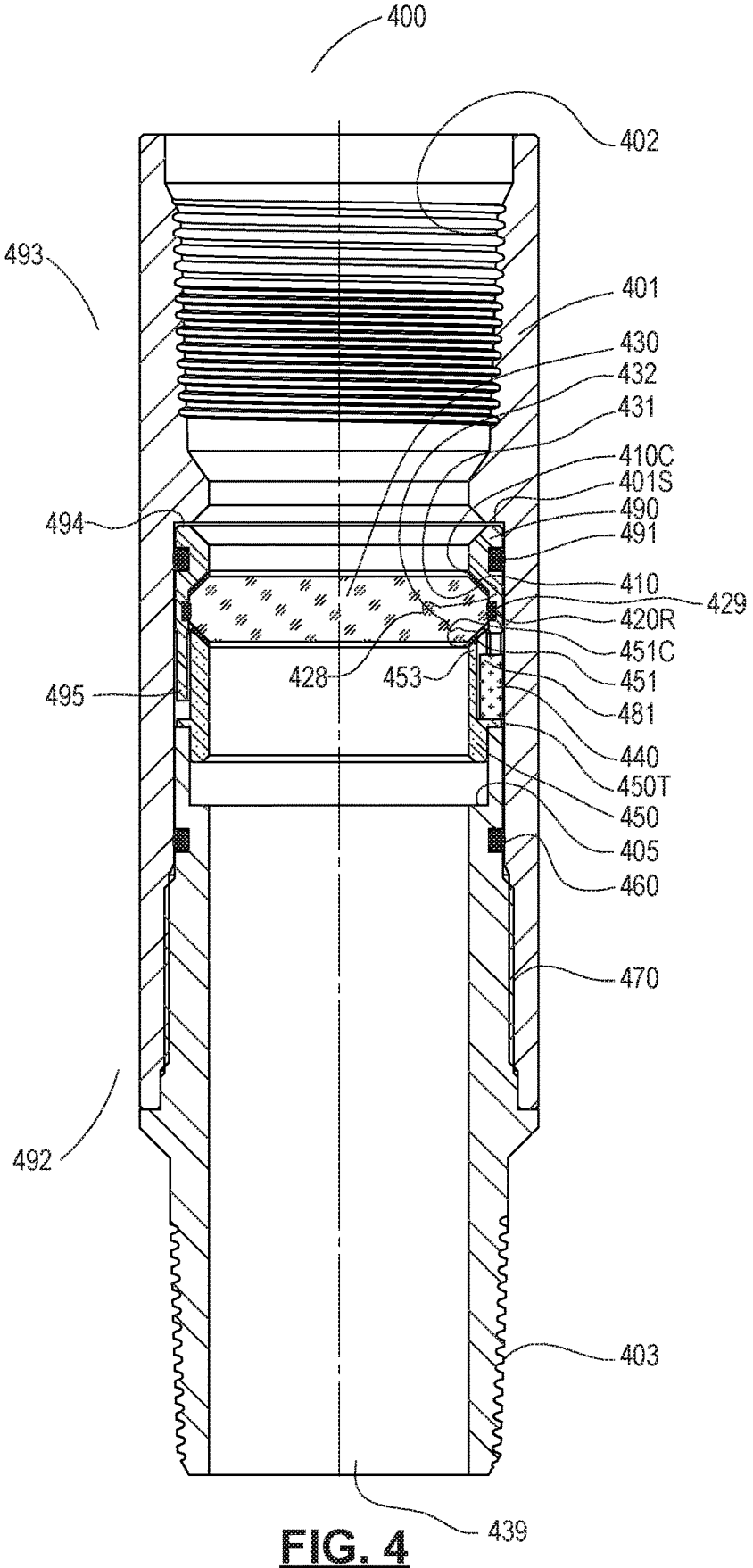
FIG. 4 illustrates a sectional view of an additional embodiment of the temporary tubing plug in a first, or run-in, position, which reveals a temporary tubing plug where an upper support cushion is permanently bonded to a piston sleeve that is in sealing engagement with the housing of the temporary tubing plug, and the resilient seal between the frangible plug and the piston sleeve is permanently bonded to the rigid substrate of the piston sleeve with the shear sleeve support surface having a lower support cushion permanently bonded to its surface.

With reference to FIG. 4, the general components of a temporary tubing plug device 400 are illustrated in an additional embodiment, which include a first end 493 and second end 492 of temporary tubing plug device 400. Temporary tubing plug device 400 has a housing 401 which has an upper housing connection 402 and a lower housing connection 403. The upper housing connection 402 and the lower housing connection 403 allow for the temporary tubing plug device 400 to be attached within a pipe string (not illustrated) between connections of two pipe segments (not illustrated). In embodiments, first end 493 of temporary tubing plug device 400 (i.e., first end 493 of housing 401) is connected to a pipe string. In embodiments, first end 493 of at least one other portion of housing 401 is connected to a pipe string. A piston plug 490 resides within the housing 401. Piston plug 490 has a piston plug first end 494 and piston plug second end 495. The piston plug first end 494 of piston plug 490 points toward the upper housing connection 402. The movement of the piston plug 490 toward the first end 493 of the temporary tubing plug device 400 is limited by upper shoulder 401S. A frangible plug 430 resides within the piston plug 490 and held in place on its first support surface 431 within the piston plug 490 by upper support shoulder 410, which has a resilient cushion support 410C that is permanently bonded to upper support shoulder 410. Upper support shoulder 410 may be formed of any suitable material for wellbore use. In embodiments, resilient cushion support rigid substrate 428 forms upper support shoulder 410. Resilient cushion support rigid substrate 428 may be composed of any suitable materials for use with temporary tubing plug device 400 in a well bore environment. In embodiments, resilient cushion support rigid substrate 428 is a metallic substrate. The metallic substrate used to form resilient cushion support rigid substrate 428 may be made from similar materials used for manufacture of pipe segments, including but not limited to carbon steel, cast iron, chrome, inconel, bronze, aluminum, or any combinations thereof. Because the piston plug first end 494 of the piston plug 490 has limited movement toward the first end 493 of the temporary tubing plug device 400, frangible plug 430 is held in place against pressure which comes from below the frangible plug 430. Frangible plug 430 is held in its run-in, or first, position on its second support surface 432, by the lower support shoulder 451, which has a resilient cushion support 451C which is permanently bonded to lower support shoulder 451 of the activation sleeve 450. In embodiments, resilient cushion support 451C is permanently bonded to activation sleeve rigid substrate 453 that forms upper support shoulder 451 of activation sleeve 450. Activation sleeve rigid substrate 453 may be composed of any suitable materials for use with temporary tubing plug device 400 in a well bore environment. In embodiments, activation sleeve rigid substrate 453 is a metallic substrate The metallic substrate used to form resilient elastomeric portion rigid substrate 453 may be made from rigid materials, including but not limited to carbon steel, cast iron, chrome, inconel, bronze, aluminum, or any combinations thereof. Frangible plug 430 may be composed of any suitable material such as glass, ceramic, graphite, ionic solids, or any combinations thereof. In an embodiment, frangible plug 430 comprises glass.

As shown in FIG. 4, activation sleeve 450 is releasably connected to housing 401 by activation shear tab 450T of the activation sleeve 450. The activation shear tab 450T is manufactured to "shear", or break, at a predetermined force (i.e., pressure) which is achieved by hydraulic pressure against the frangible plug 430 which is in sealing engagement with an internal surface of housing 401. The sealing engagement is accomplished because frangible plug 430 is in sealing engagement with piston plug 490 by resilient elastomeric portion 420R which is permanently bonded to a piston plug rigid substrate 429 of the piston plug 490. Resilient elastomeric portion 420R may be composed of any suitable components. In embodiments, resilient elastomeric portion 420R comprises rubber, polyurethane, or any combinations thereof. Resilient elastomeric portion 420R may have any suitable Shore A hardness. In embodiments resilient elastomeric portion 420R has a Shore A hardness of 85-95 durometers. And, piston plug 490 is in sealing engagement with an internal surface of housing 401 by virtue of piston seal 491 which provides sealing engagement between piston plug 490 and housing 401. Impact pin 440 is held in place between the activation sleeve 450 and the housing 401. Impact pin 440 has an upper end 481 which is configured to rupture the frangible plug 430, upon impact. The upper end 481 of impact pin 440 is spaced away from the frangible plug 430 while temporary tubing plug device 400 is in its first, or plugged, position. Stop shoulder 405, located within housing 401, is configured to stop downward movement of the activation sleeve 450 when it reaches the second, or open, position. In embodiments as shown, frangible plug 430 is thereby releasably connected within (i.e., to) housing 401 via activation sleeve 450.

Housing 401 in this embodiment of FIG. 4 is split into two components in order to a create a cavity for the frangible plug 430 and the other internal components. The two components which makeup the entirety of housing 401 are shown to be connected by coupling thread 470 and the two components are sealingly engaged by use of coupling seal 460.

As shown in FIG. 4, the second, or open, position (not shown in this disclosure) of the temporary tubing plug device 400 is accomplished by breaking or shearing of the activation shear tab 450T. Activation shear tab 450T breaks off of activation sleeve 450 when a prescribed hydraulic pressure is applied above the frangible plug 430. The range of force, or pressure, which may be desired for activation is dependent on the application in which the temporary tubing plug device 400 is utilized. The pressure may be low, such as 500 psi, in an application where the frangible plug 430 is desired to hold pressure from below the temporary tubing plug device 400. The pressure may be significantly high, such as 20,000 psi, for applications where the frangible plug 430 is desired to hold a pressure differential applied above the temporary tubing plug device 400, such as, for activation of equipment placed up-hole in the pipe string, or floating pipe into a well by creation of an atmospheric chamber below the temporary tubing plug device 400. From the moment the activation shear tab 450T breaks, the frangible plug 430 is forced toward the second end 492 of the temporary tubing plug device 400, as the activation sleeve 450 is pushed toward the stop shoulder 405, the frangible plug 430, is impaled by impact pin 440, which causes pulverization (i.e., frangible plug 430 breaks into small pieces) of the frangible plug 430. In addition, the small pieces of broken frangible plug 430 are moved through the pipe string which leaves temporary tubing plug device 400 with an axial passageway 439 having an equal or greater diameter to the pipe string.

Advantages of temporary tubing plug device 400 are that resilient cushion support 410C and resilient elastomeric portion 420R remain permanently bonded to the piston plug rigid substrate 429 of the piston plug 490. Further, resilient cushion support 451C remains permanently bonded to its activation sleeve rigid substrate 453 of the activation sleeve 450. So, all of those resilient materials are retained within the open temporary tubing plug device 400, away from the axial internal passageway 439 of the temporary tubing plug device 400 (i.e., axial internal passageway 439 of housing 401), and therefore are not lost within the well bore to cause future problems with well operations or production operations.

Although the present invention and its advantages have been described in detail, it should be understood that various changes, substitutions and alterations may be made herein without departing from the spirit and scope of the invention as defined by the appended claims.

What is claimed is:

1. An apparatus for temporary plugging of a pipe string, the temporary tubing plug apparatus comprising:

a housing comprising an axial internal passageway, wherein the housing is connected to a pipe string on at least a first end of the housing; and a frangible plug, comprising a first support surface and a second support surface, wherein the frangible plug resides within the housing and is held in place on the first support surface within the housing by an upper support shoulder, wherein the upper support shoulder comprises a resilient cushion support, wherein the resilient cushion support is permanently bonded to the upper support shoulder;

wherein the frangible plug is in sealing engagement with the housing through a bonded seal, wherein the bonded seal comprises a resilient elastomeric portion, wherein the resilient elastomeric portion remains permanently bonded to a resilient elastomeric portion rigid substrate of the bonded seal, wherein the resilient elastomeric portion and the resilient cushion support are retained within the apparatus for temporary plugging of the pipe string, away from the axial internal pathway of the apparatus for temporary plugging of the pipe string.

2. The apparatus of claim 1, wherein an impact pin is held in place between an activation sleeve and the housing.

3. The apparatus of claim 1, and wherein the frangible plug is releasably connected with the housing via the activation sleeve.

4. The apparatus of claim 3, wherein the activation sleeve comprises an activation shear tab.

5. The apparatus of claim 4, wherein the shear tab breaks off of the activation sleeve when a prescribed hydraulic pressure is applied above the frangible plug.

6. The apparatus of claim 5, wherein when the prescribed pressure is applied above the frangible plug, the frangible plug subsequently releases from the housing with the frangible plug falling into the impact pin so that the frangible plug breaks apart forming small particles and the small particles are moved through the pipe string, wherein the temporary tubing plug apparatus is left with an axial passageway that is equal, or larger, in diameter to the pipe string.

7. The apparatus of claim 1, wherein the resilient elastomeric portion comprises rubber, polyurethane, or any combinations thereof.

8. The apparatus of claim 7, wherein the resilient elastomeric portion comprises a Shore A hardness within the range of 85-95 durometers.

9. The apparatus of claim 1, wherein the frangible plug is made from glass.

10. A temporary tubing plug apparatus for temporary plugging of a pipe string, comprising:

a housing comprising an axial internal passageway, wherein the housing is connected to a pipe string on at least a first end of the housing; and a frangible plug comprising a first support surface and a second support surface, wherein the frangible plug resides within the housing and is held in place on the first support surface within the housing by an upper support shoulder, wherein the upper support shoulder comprises a resilient cushion support, wherein the resilient cushion support is permanently bonded to the upper support shoulder, and further wherein the frangible plug is connected with the housing via an activation sleeve and the second support surface of the frangible plug is supported by a lower support shoulder;

wherein the frangible plug is in sealing engagement with the housing through a bonded seal, wherein the bonded seal comprises a resilient elastomeric portion, wherein the resilient elastomeric portion remains permanently bonded to a resilient elastomeric portion rigid substrate of the bonded seal, wherein the resilient elastomeric portion and the resilient cushion support are retained within the apparatus for temporary plugging of the pipe string, away from the axial internal pathway of the apparatus for temporary plugging of the pipe string.

11. The apparatus of claim 10, wherein the activation sleeve comprises an activation shear tab.

12. The apparatus of claim 11, wherein the shear tab breaks off of the activation sleeve when a prescribed hydraulic pressure is applied above the frangible plug.

13. The apparatus of claim 10, wherein the frangible plug is releasably connected with the housing via the activation sleeve.

14. The apparatus of claim 13, wherein when the prescribed pressure is applied above the frangible plug, and wherein the frangible plug subsequently releases from the housing with the frangible plug falling into an impact pin so that the frangible plug breaks apart forming small particles and the small particles are moved through the pipe string, wherein the temporary tubing plug apparatus is left with an axial passageway that is equal, or larger, in diameter to the pipe string.

15. The apparatus of claim 13, wherein the resilient elastomeric portion comprises rubber, polyurethane, or any combinations thereof.

16. The apparatus of claim 13, wherein the resilient elastomeric portion comprises a Shore A hardness within the range of 85-95 durometers.

17. The apparatus of claim 10, wherein the frangible plug is made from glass.

* * * * *